US011781781B2

(12) United States Patent
Solis et al.

(10) Patent No.: US 11,781,781 B2
(45) Date of Patent: Oct. 10, 2023

(54) LINE OF SIGHT BLOCKING GRILLE ASSEMBLY

(71) Applicant: Air Distribution Technologies IP, LLC, Milwaukee, WI (US)

(72) Inventors: Brian J. Solis, Frisco, TX (US); Steven J. Purdie, Allen, TX (US); Timothy C. Huggins, Durant, OK (US); Patrick R. Barnum, Allen, TX (US)

(73) Assignee: Air Distribution Technologies IP, LLC, Milwaukee, WI (US)

( * ) Notice: Subject to any disclaimer, the term of this patent is extended or adjusted under 35 U.S.C. 154(b) by 0 days.

(21) Appl. No.: 17/715,817

(22) Filed: Apr. 7, 2022

(65) Prior Publication Data

US 2022/0228770 A1 Jul. 21, 2022

Related U.S. Application Data

(63) Continuation of application No. 16/017,705, filed on Jun. 25, 2018, now abandoned.

(60) Provisional application No. 62/663,740, filed on Apr. 27, 2018.

(51) Int. Cl.
*F24F 13/14* (2006.01)
*F24F 13/28* (2006.01)

(52) U.S. Cl.
CPC ..... *F24F 13/1413* (2013.01); *F24F 13/142* (2013.01); *F24F 13/28* (2013.01)

(58) Field of Classification Search
CPC ..... F24F 13/28; F24F 13/142; F24F 13/1413
USPC ..... 454/319
See application file for complete search history.

(56) References Cited

U.S. PATENT DOCUMENTS

| | | | | |
|---|---|---|---|---|
| 1,691,162 | A * | 11/1928 | Miller | F24F 13/08 454/224 |
| 3,660,956 | A * | 5/1972 | Budlong | E04C 2/423 52/669 |
| 4,334,899 | A | 6/1982 | McConnell | |
| 5,601,485 | A * | 2/1997 | Gigola | A01K 1/0064 454/277 |
| 5,755,069 | A * | 5/1998 | Sullivan | F24F 13/082 52/220.8 |
| 5,987,908 | A | 11/1999 | Wetzel | |
| 6,321,637 | B1 | 11/2001 | Shanks et al. | |
| 7,258,607 | B1 | 8/2007 | Machiorlette et al. | |
| 9,518,757 | B2 | 12/2016 | Boyce | |

(Continued)

FOREIGN PATENT DOCUMENTS

| | | | |
|---|---|---|---|
| JP | 2014062704 | A | 4/2014 |
| WO | 2014116735 | A1 | 7/2014 |
| WO | 2017123170 | A1 | 7/2017 |

*Primary Examiner* — Allen R. B. Schult
(74) *Attorney, Agent, or Firm* — Fletcher Yoder, P.C.

(57) ABSTRACT

A grille assembly having a housing includes a corridor between a first end and a second end of the housing. The grille assembly includes a core disposed within the corridor and having a plurality of blades that guide fluid flow through the housing. A first portion of the plurality of blades is slanted in a first direction at a first non-perpendicular angle relative to a corridor axis. The grille assembly also includes a second portion of the plurality of blades slanted in a second direction that is substantially opposite the first direction at a second non-perpendicular angle relative to the corridor axis. The core obstructs a line of sight from the first end to the second end of the housing.

19 Claims, 5 Drawing Sheets

(56) References Cited

U.S. PATENT DOCUMENTS

| | | | | |
|---|---|---|---|---|
| 2011/0061414 | A1 | 3/2011 | McAllister, II et al. | |
| 2014/0335773 | A1 | 11/2014 | Takahashi et al. | |
| 2021/0017759 | A1* | 1/2021 | Sykes | E04B 1/7076 |

* cited by examiner

LINE OF SIGHT BLOCKING GRILLE ASSEMBLY

CROSS REFERENCE TO RELATED APPLICATIONS

This application is a continuation of U.S. patent application Ser. No. 16/017,705, filed Jun. 25, 2018, entitled "LINE OF SIGHT BLOCKING GRILLE ASSEMBLY," which claims priority from and the benefit of U.S. Provisional Patent Application No. 62/663,740, filed Apr. 27, 2018, entitled "LINE OF SIGHT BLOCKING GRILLE ASSEMBLY," the disclosures of which are hereby incorporated by reference in their entireties for all purposes.

BACKGROUND

The present disclosure relates generally to a grille assembly and, more particularly, to an air grille assembly for an air duct of a heating, ventilation, and air conditioning (HVAC) system.

A wide range of applications exist for HVAC systems. For example, residential, light commercial, commercial, and industrial systems are used to control temperatures and air quality in residences and buildings. HVAC systems include ducts that guide airflow. Access into and out of these ducts is often provided via air grille assemblies. As an example, air return ducts remove air from a room and return the air to the HVAC system. Recycling the air through the air return duct maintains pressure within the building or home during operation of the HVAC system. The source air of the air removed from the room often includes airborne particulates, such as pollen, dust, and other airborne debris, that may damage the HVAC system. Accordingly, air grille assemblies are positioned at an opening of the air return duct or a plenum positioned upstream of the air return duct to remove large airborne debris (e.g., a balloon) and conceal the air return duct. In certain HVAC systems, the air grille assemblies may include a filter frame having a filter that removes the airborne particulates from the air before returning the air to an HVAC unit of the HVAC system. Air grille assemblies may also be used with different ducts and components of an HVAC system. Such air grille assemblies are typically located on a wall, ceiling, or floor of a room. Therefore, the air grille assemblies are generally visible to a person. It should be noted that air grille assemblies may also be utilized in conjunction with other features, such as dampers, to provide products, such as registers for use in HVAC systems. Other grille assemblies may be employed in different systems to facilitate, guide, or manage flow. SUMMARY A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In accordance with a first embodiment, a grille assembly having a housing including a corridor between a first end and a second end of the housing. The housing may be fluidly couple with a duct. The grille assembly also includes a core disposed within the corridor and having a plurality of blades that may guide fluid flow through the housing and a first portion of the plurality of blades slanted in a first direction at a first non-perpendicular angle relative to a corridor axis. The first portion of the plurality of blades are spaced relative to one another to form a first plurality of channels that partially pass through the housing. The grille assembly also includes a second portion of the plurality of blades slanted in a second direction that is substantially opposite the first direction at a second non-perpendicular angle relative to the corridor axis. The second portion of the plurality of blades are spaced relative to one another to form a second plurality of channels that partially pass through the housing and the first and second plurality of channels are arranged such that a line of sight from the first end to the second end of the housing is obstructed.

In accordance with a second embodiment, a grille assembly having a housing including a corridor extending from a first end portion to a second end portion of the housing and a core disposed within the housing. The core including a first core unit having a first plurality of blades that are each spaced apart relative to one another along a length of the first core and slanted in a first direction at a first angle relative to a corridor axis and a second core unit including a second plurality of blades that are each spaced apart relative to one another along a length of the second core unit and slanted in a second direction at a second angle relative to the corridor axis. The second core unit is positioned relative to the first core unit such that the first and second plurality of blades form a plurality of channels extending from an inlet disposed in the first core unit to an outlet disposed in the second core unit and the plurality of channels are deviated such that a line of sight the first end portion to the second end portion via the corridor is obstructed.

In accordance with a third embodiment, a grille assembly including a first core unit having a first plurality of blades. Each blade of the first plurality of blades is slanted in a first direction at a first angle relative to a corridor axis of the grille assembly. The grill assembly also includes a second core unit including a second plurality of blades, each blade of the second plurality of blades is slanted in a second direction at a second angle relative to the corridor axis. The second direction is substantially opposite the first directions, and the second core unit is positioned adjacent the first core unit such that a first end of each blade of the second plurality of blades is aligned with a second end of a respective blade of the first plurality of blades. The grille assembly also includes a channel extending from an inlet disposed in the first core unit to an outlet disposed in the second core unit. Each blade of the first and second plurality of blades are spaced apart relative to one another along the corridor axis to form the channel, and a line of sight from an inlet to an outlet of the channel is occluded.

DRAWINGS

Figure 4:
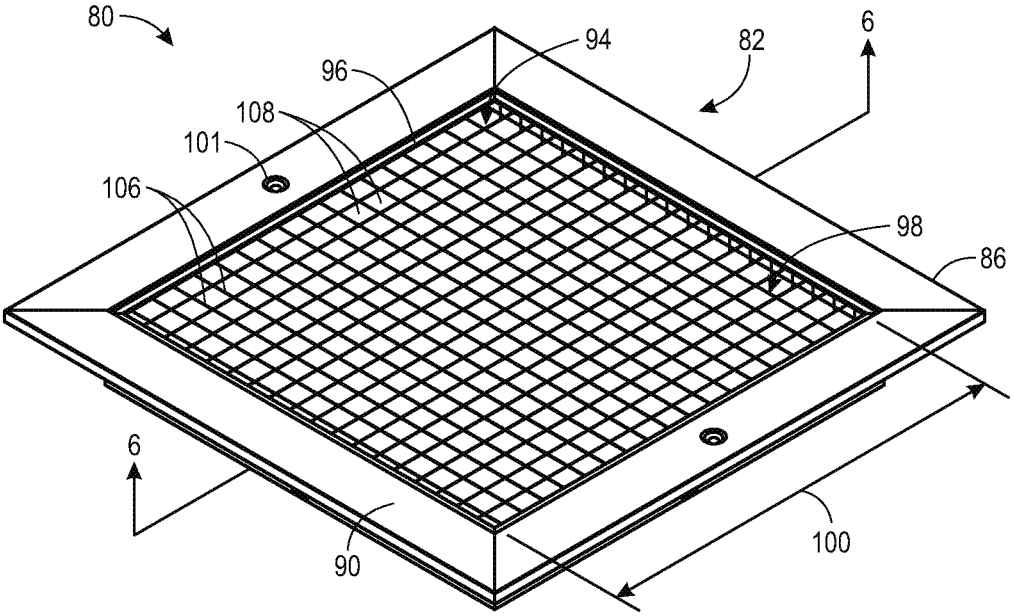
FIG. 4 is a perspective view of an embodiment of a room side face of an air grille assembly that may be positioned over an opening of an air duct of the HVAC system of FIGS. 1 and 3, the air grille assembly having a core positioned within a corridor and including a plurality of deviated channels that obstruct visibility of the air duct, in accordance with embodiments described herein.
Figure 7:
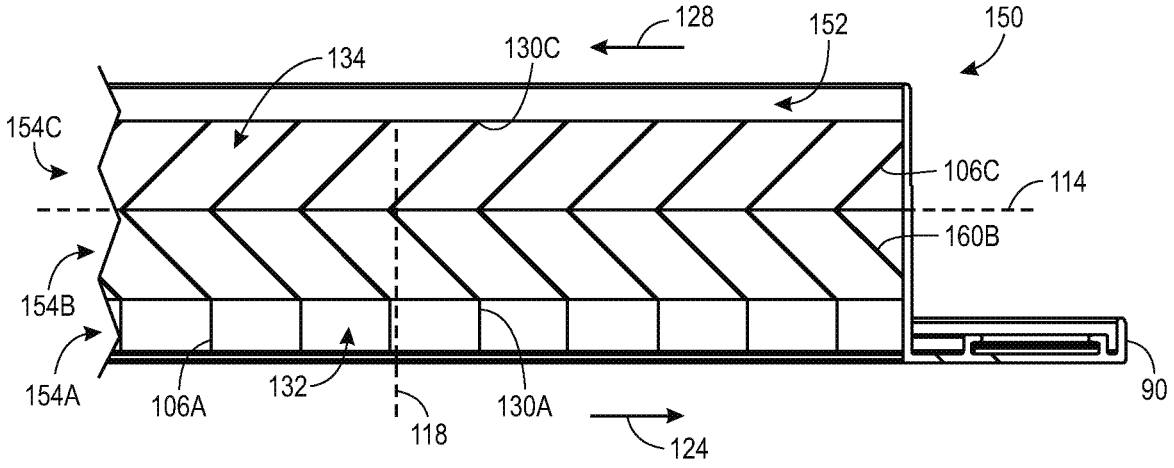
Figure 8:
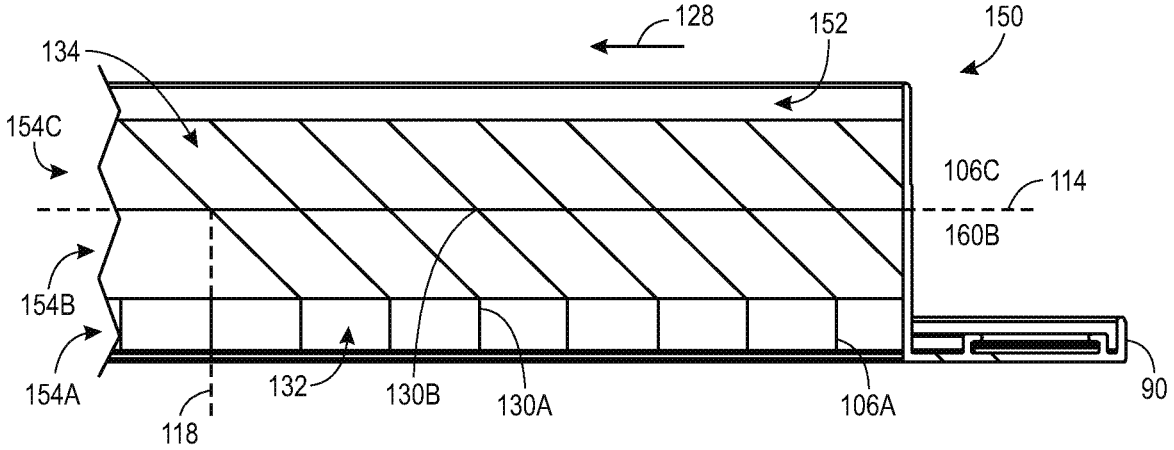

FIG. 7 is a cross-sectional view of an embodiment of the air grille assembly of FIG. 4, whereby the core includes one row of blades positioned orthogonal to the corridor axis and two rows of blades slanted relative to the corridor axis to form the deviated channel, the blades in each respective row of the two slanted rows are slanted in opposite directions, in accordance with embodiments described herein; and FIG. 8 is a cross-sectional view of an embodiment of the air grille assembly of FIG. 4, whereby the core includes one row of blades positioned orthogonal to the corridor axis and two rows of blades slanted relative to the corridor axis to form the deviated passageway, the blades in each respective row of the two slanted rows are slanted in the same direction, in accordance with embodiments described herein.

DETAILED DESCRIPTION

The present disclosure is directed toward grille assemblies and, more particularly, air grille assemblies for use with air ducts of heating, ventilation, and air conditioning (HVAC) systems. For example, air grille assemblies of the present disclosure conceal an air duct or open plenum space by completely or partially obstructing a line of sight through the air grille assembly from a room side to a duct side/plenum side of the air grille assembly. Additionally, the air grille assemblies disclosed herein may include a filter utilized to remove air and airborne particulates from a room and return air to an HVAC unit of the HVAC system via the air return duct. The disclosed air grille assemblies include a core having stacked rows of blades that are arranged in a manner that forms a deviated channel, or V-shaped channel, from a room side inlet to a duct side outlet of the air grille assembly. The deviated channel obstructs a line of sight of an observer looking into the air grille assembly from at any location within the room. As such, the disclosed air grille assembly improves the appearance and aesthetics of a room with a return air grille. It should be noted that while the discussion of present embodiments is generally provided in the context of air grille assemblies for air return ducts, the disclosed air grille assemblies can also be used with other features, such as air supply ducts. Indeed, grille assemblies in accordance with present embodiments may be used with various ducts, which may include different types of channels and flow paths.

Figure 1:
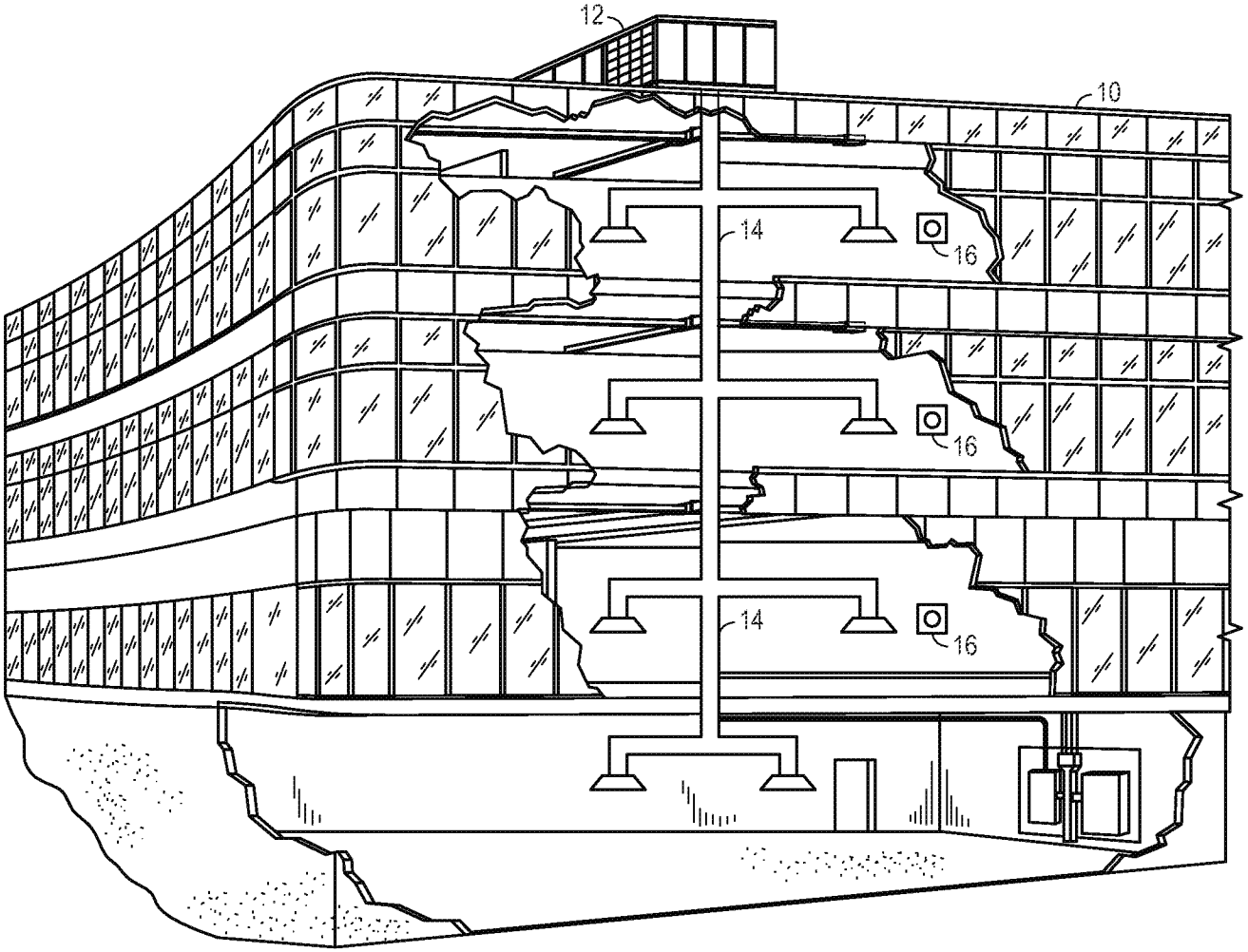
FIG. 1 is a perspective view a heating, ventilating, and air conditioning (HVAC) system for building environmental management, in accordance with embodiments described herein.

Turning now to the drawings, FIG. 1 illustrates a heating, ventilation, and air conditioning (HVAC) system for building environmental management that may employ one or more HVAC units and air grille assemblies in accordance with present embodiments. In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
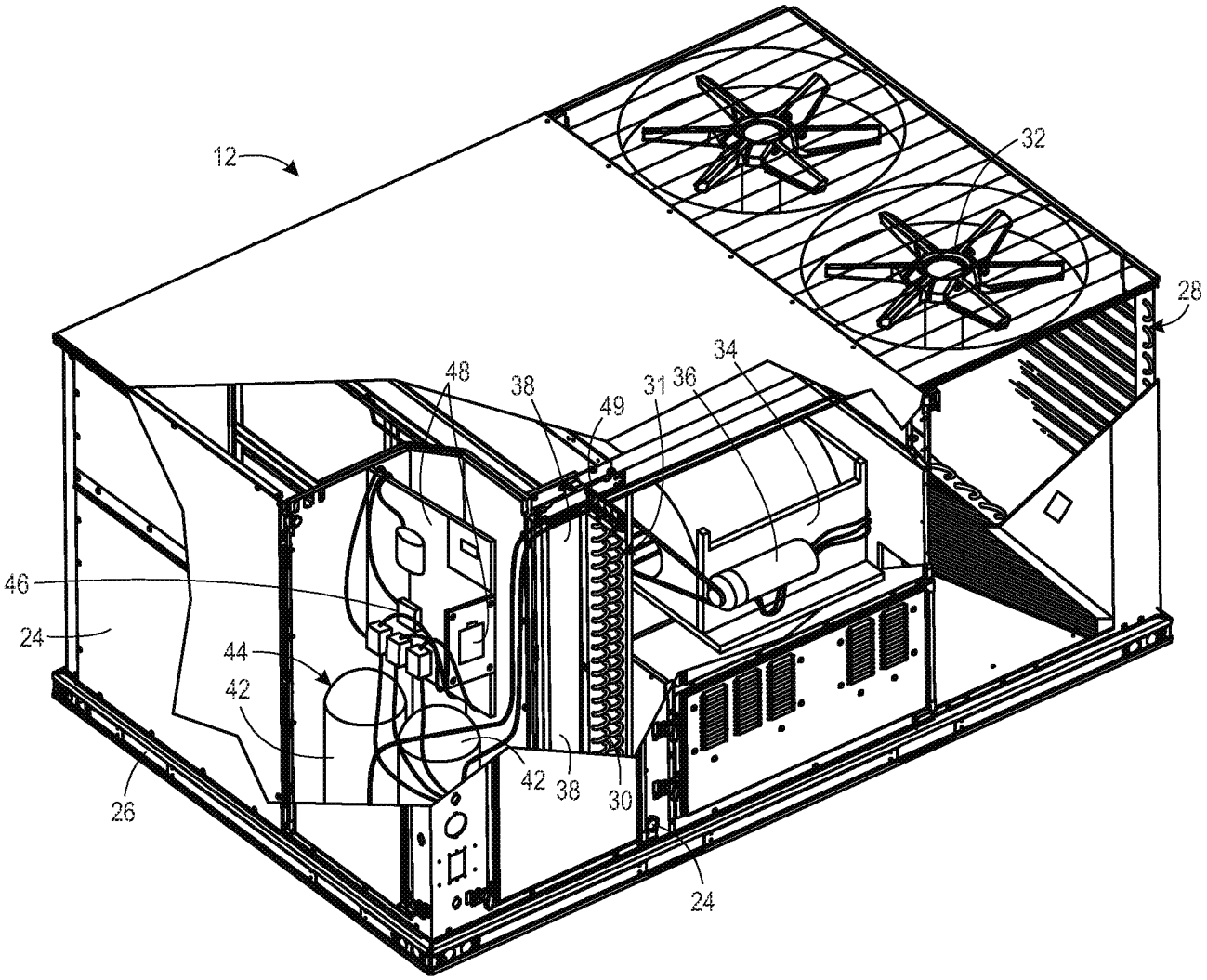
FIG. 2 is a perspective view of the packaged HVAC unit of the HVAC system of FIG. 1, in accordance with embodiments described herein.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits.

Tubes within the heat exchangers 28 and 30 may circulate refrigerant through the heat exchangers 28 and 30. For example, the refrigerant may be R-410A. The tubes may be of various types, such as multichannel and/or microchannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the rooftop unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
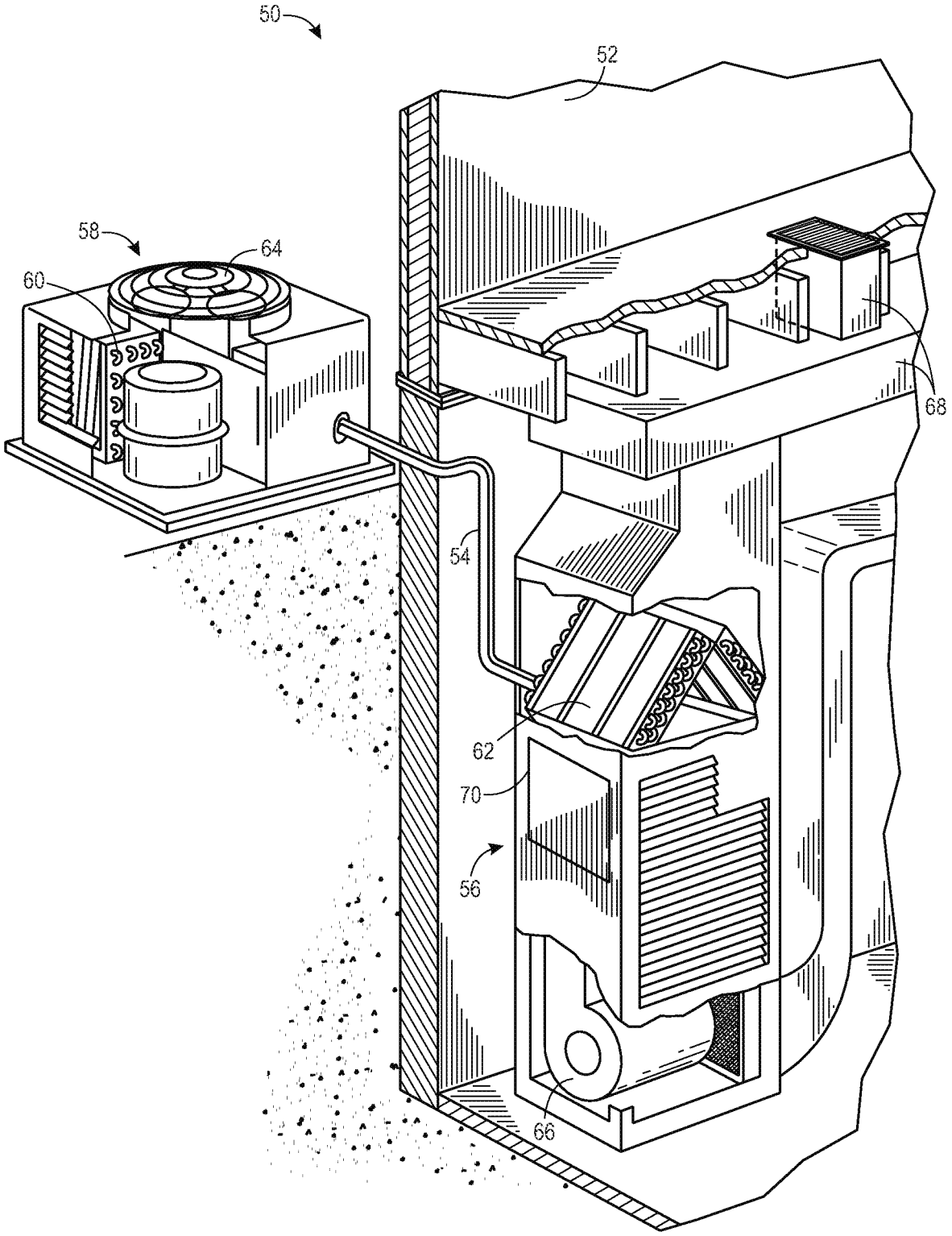
FIG. 3 is a perspective view of a residential HVAC system, in accordance with embodiments described herein.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over the heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 5:
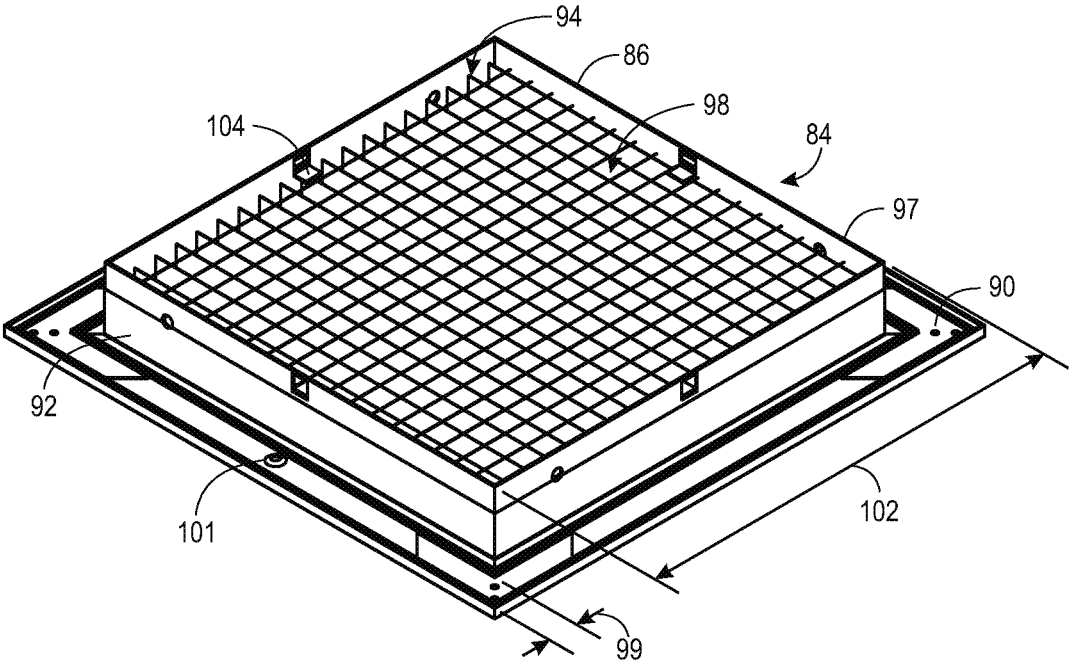
FIG. 5 is a perspective view of the duct side of the air grille assembly of FIG. 4, in accordance with embodiments described herein.

FIGS. 4 and 5 illustrate an embodiment of an air grille assembly 80 that can be positioned over an open end of a duct, such as an air return duct, or a plenum upstream of the duct associated with any of the systems described above. FIG. 4 illustrates a room side end face 82 of the air grille assembly 80, and FIG. 5 illustrates a duct/plenum side end face 84 of the air grille assembly 80. In one embodiment, the air grille assembly 80 operates to return air to the HVAC unit 12 via the air return duct of the HVAC system. Additionally, the air grille assembly 80 conceals the air return duct, which improve the aesthetics of the room.

The air grille assembly 80 includes a housing 86 having a flange 90 on the room side end face 82 and a corridor 92 extending away from the flange 90 toward the duct/plenum side end face 84. The corridor 92 may be a single wall or an assembly of walls that forms a channel 94 that allows airflow therethrough. For example, air from a room may flow into an air return duct or plenum of the HVAC system via the channel 94. The channel 94 defines a room side opening 96 and a duct side opening 97. The channel 94 is sized to fit within an open end of a duct, such as an air return duct, of the HVAC system. The flange 90 extends a distance 99 away from the corridor 92 to facilitate coupling of the air grille assembly 80 to a wall, ceiling, or floor of a room. The flange 90 extends a distance 99 away from the corridor 92 to facilitate installation of the air grille assembly 80 into a T-Bar lay in ceiling grid system. For example, once positioned over the open end of an air return duct, the air grille assembly 80 may be secured onto a desired surface by inserting a coupling member into a receptacle 101 of the flange 90. By way of non-limiting example, the coupling member may include a nail, screw, bolt, or any other suitable coupling member that can be used to secure the air grille assembly 80 to the desired surface. In certain embodiments, the air grille assembly 80 may be installed in a ceiling T-Bar grid system with no return air ductwork.

In the illustrated embodiment, a core 98 is nested within the channel 94 of the corridor 92 such that the core is generally adjacent or forms part of the room side end face 82. The room side opening 96 may have a dimension 100 that is smaller than a dimension 102 of the duct side opening 97. For example, a perimeter or length of the room side opening 96 may be incrementally smaller than a respective perimeter or length of the duct side opening 97. The core 98 may be inserted into the corridor 92 through the duct side opening 97 and sized to fit within the channel 94. The dimensions of the core 98 are larger than the dimension 100 of the room side opening 96 such that the core 98 is unable to fit through the room side opening 96. The smaller dimension 100 of the room side opening 96 creates an abutment surface in the channel 94 that supports the core 98 within the housing 86.

The core 98 may be secured within the channel 94 via fasteners 104 disposed on the corridor 92 of the housing 86. In certain embodiments, the fasteners 104 include a deformable tab or cantilever that may be moved from a first position that is parallel to a corresponding feature of the corridor 92 to a second position that is orthogonal to a corresponding feature of the corridor 92. In the second position, the deformable tab abuts against a duct side end of the core 98 to secure the core 98 within the channel 94. In other embodiments, the fasteners 104 may include resilient tabs that secure the core 98 in the channel 94 via a snap-fit mechanism. In certain embodiments, the air grille assembly 80 may include a filter adjacent to the core 98 on the duct side end of the core 98. The filter may capture additional airborne particulates that may have flowed into the air grille assembly 80. Additionally, the filter may occlude any portion of the air duct that may remain visible through the air grille assembly 80.

The core 98 includes features that may conceal the duct side of the air grille assembly 80 from an observer on the room side. For example, the core 98 includes a plurality of blades 106, 107. The blades 106, 107 form a grid pattern that divides the channel 94 into a plurality of deviated channels 108. That is, the blades 106, 107 are arranged in a cross-wise configuration. The deviated channels 108 direct airflow through the air grille assembly 80 to a desired location, such as to the air return duct of the HVAC system. As discussed in further detail below, the deviated channels 108 completely or partially obstruct visibility through the air grille assembly (such as into the air return duct) when an observer is looking into the air grille assembly 80 from any location within the room. For example, a configuration of the deviated channels 108 may result in a visibility through the air grille assembly 80 that is between 0% and approximately 20%. In certain embodiments, the core 98 includes a filer frame having a filter that facilitates removal of airborne particulates in air passing therethrough and conceals the dust side of the air grille assembly 80 from an observer on the room side.

Figure 6:
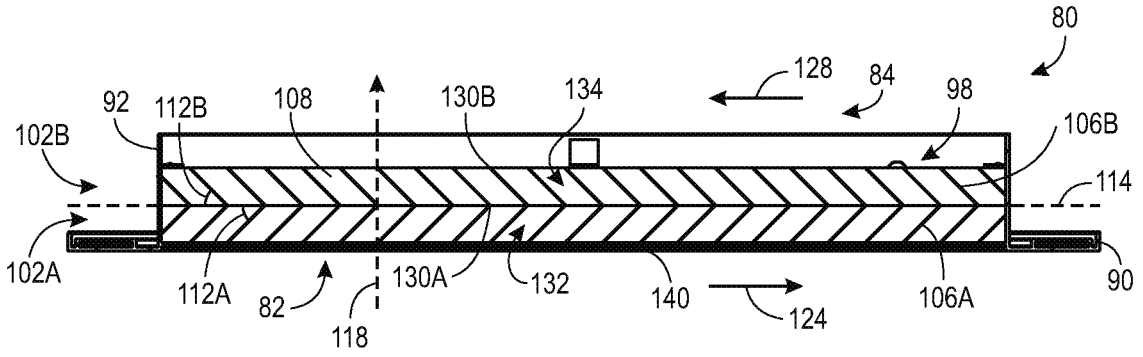
FIG. 6 is a cross-sectional view of an embodiment of the air grille assembly of FIG. 4 along line 6-6, whereby the core includes two rows of blades slanted relative to a corridor axis and that form the deviated passageways, in accordance with embodiments described herein.

FIG. 6 is a cross-sectional view of an embodiment of the air grille assembly 80 in which the blades 106 are oriented at a non-perpendicular angle 112 relative to a corridor axis 114 of the core 98, and the blades 107 are oriented orthogonal to the corridor axis 114. It should be noted that the corridor axis 114 is generally transverse, or orthogonal, to a flow path of air through the corridor 92, as it would be without the core 98 disposed therein. The blades 106 are slanted and the blades 107 are at an angle of approximately 90 degrees relative to the corridor axis 114 when considered from a common perspective. The blades 107 are spaced apart (evenly in the illustrated embodiment) along the dimension 100 and run orthogonal to the blades 106 along their length, thereby forming the grid pattern and splitting the channel 94 into the deviated channels 108. It should be noted that the blades 107 are now shown in the cross-sectional view of FIG. 6 but form border walls of at least portions of the deviated channels 108 in certain embodiments.

The slanted orientation of the blades 106 obstruct a line of sight 118 through the air grille assembly 80 from the room side face 82 to the duct side face 84, thereby concealing the associated duct from observation from the room. For example, the core 98 includes a first row 102*a* having the plurality of blades 106*a* extending along a length 122 of the channel 94 and slanted in a first direction 124 such that each blade 106*a* is oriented at the non-perpendicular angle 112*a* relative to the corridor axis 114. A second row 102*b* having the plurality of blades 106*b* extending along the length 122 is positioned above the first row 120*a* such that each blade 106*b* in the second row 102*b* is aligned with a respective blade 106*a* in the first row 102*a*. The blades 106*b* in the second row 102*b* are slanted in a second direction 128 that is substantially opposite the first direction 124. As such, similar to the blades 106*a*, each blade 106*b* is oriented at the non-perpendicular angle 112*b*. By way of non-limiting example, the non-perpendicular angle 112 is between approximately 35 degrees and 50 degrees. In certain embodiments, the non-perpendicular angle 112*a*, 112*b* is the same. In other embodiments, the non-perpendicular angle 112*a* is different from the non-perpendicular angle 112*b*. For example, the non-perpendicular angle 112*a* may be 45 degrees and the non-perpendicular angle 112*b* may be 40 degrees.

The opposing slanted orientation between the blades 106*a*, 106*b* in each respective row 102*a*, 102*b* creates the deviated channel 108 and partially or completely obstructs the line of sight 118 into the duct through the air grille assembly 80. For example, in the illustrated embodiment, an end 130*b* of each blade 106*b* in the second row 102*b* is aligned with the end 130*a* of an adjacent blade 106*a* in the first row 102*a*. As such, each blade 106*b* in the second row 102*b* extends over an inlet 132 of the deviated channel 108 in a manner that obstructs a view of the air duct through an outlet 134 of the deviated channel 108. However, in other embodiments, the ends 130*a*, 130*b* of each respective blade 106*a*, 106*b* are not aligned. For example, in certain embodiments, the blades 106*b* may be slanted such that the non-perpendicular angle 112*b* is less than 45 degrees. Therefore, the end 130*b* may extend past the end 130*a* of a respective adjacent blade 106*a*. In one embodiment, the end 130*b* of the blade 106*b* is aligned with an end 140 of an adjacent blade 106*a* in the first row 102*a*.

The core 98 may include any number of rows of the blades 106. Each row 102*a*, 102*b* may be a separate structure. For example, the core 98 may include core units that make up a single row 102*a*, 102*b* of the blades 106*a*, 106*b*. The core units are separate pieces that may be stacked one on top of another to form the deviated channel 108. In certain embodiments, the core units may be welded together to form a single structure. Any number of core units may be stacked within the housing 86 of the air grille assembly 80. For example, FIGS. 7 and 8 illustrate an air grille assembly 150 having a core 152 that includes three rows 154, or core units, of the blades 106. The core unit also includes the blades 107 arranged in a cross-wise configuration relative to the blades 106. In the illustrated embodiments, the blades 106*a* in the first row 154*a* are positioned orthogonal (e.g., at a 90 degree angle relative to the corridor axis 114). However, the blades 106 in the subsequent rows 154*b*, 154*c* are slanted, thereby creating the deviated channel 108 and obstructing the line of sight 118 through the air grille assembly 150 and into the air duct of the HVAC system.

In certain embodiments, the blades 106*b*, 106*c* in the respective rows 154*b*, 154*c* are slanted in opposite directions. For example, as shown in FIG. 7, the blades 106*b* in the second row 154*b* are slanted in the direction 128 and the blades 106*c* in the third row 154*c* are slanted in the substantially opposite direction 124. However, in other embodiments, the blades 106*b*, 106*c* in each respective row 154*b*, 154*c* are slanted in the same direction 124, 128, as shown in FIG. 8. The blades 106*b*, 106*c* may be slanted such that the non-perpendicular angle 112*b*, 112*c* relative to the corridor axis 114 is between approximately 35 degrees and 50 degrees. The non-perpendicular angle 112*b*, 112*c* may be the same or different in the rows 154*b*, 154*c*. In certain embodiments, each blade 106*c* is slanted such that the respective end 130*c* is aligned with the end 130*a* of a respective blade 106*a* in the first row 154*a* or the end 130*b* of an adjacent blade 106*b* in the second row 154*b*. In this way, each blade 106*c* in the third row 154*c* partially or completely obstructs the line of sight 118 from the inlet 132 to the outlet 134. Accordingly, for example, when the air grille assembly 80 is utilized as an access port for an air duct of an HVAC system, the air duct cannot be viewed via the air grille assembly 80 by a person at any location within the room.

As discussed above, one or more of the disclosed embodiments may provide one or more technical effects useful in HVAC systems associated with the use air grille assemblies. For example, the disclosed embodiments of the present approach may facilitate concealing the air duct or air plenum of the HVAC systems. By specific example, the air grille assembly may include a core having rows of blades stacked on top of one another where the blades in each row are slanted to form a deviated channel that extends from a room side face to a duct/plenum side face of the air grille assembly. The blades in the row adjacent to the duct/plenum side face of the air grille assembly block a line of sight from the inlet to the outlet of the deviated channel. As such, the associated duct/plenum is not visible when looking into the air grille assembly from any location within the room. It should be noted that the embodiments described in the specification may have other technical effects and can solve other technical problems.

While only certain features and embodiments of the invention have been illustrated and described, many modifications and changes may occur to those skilled in the art (e.g., variations in sizes, dimensions, structures, shapes and proportions of the various elements, values of parameters (e.g., temperatures, pressures, etc.), mounting arrangements, use of materials, colors, orientations, etc.) without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the invention. Furthermore, in an effort to provide a concise description of the exemplary embodiments, all features of an actual implementation may not have been described (i.e., those unrelated to the presently contemplated best mode of carrying out the invention, or those unrelated to enabling the claimed invention). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A grille assembly, comprising:

a housing comprising a room side end having a room side opening, a duct side end having a duct side opening, and a corridor extending between the room side opening and the duct side opening; and a core comprising a plurality of blades, wherein the plurality of blades comprises:

a first subset of blades spaced apart relative to one another; and a second subset of blades spaced apart relative to one another, wherein, in an installed configuration of the core within the housing, the first subset of blades is slanted in a first direction at a first angle relative to the housing, the second subset of blades is slanted in a second direction, substantially opposite the first direction, at a second angle relative to the housing, and the first subset of blades and the second subset of blades abut one another within the corridor, and wherein the duct side opening and the corridor are sized to receive the core, and the room side opening is sized to block translation of the core through the room side opening to retain the core within the housing in the installed configuration of the core, and wherein the plurality of blades is arranged to obstruct a line of sight though the corridor from the room side end to the duct side end of the housing.

2. The grille assembly of claim 1, wherein the core comprises a first core unit and a second core unit, wherein the first core unit comprises the first subset of blades, the second core unit comprises the second subset of blades, and the first core unit is separate from the second core unit.

3. The grille assembly of claim 2, wherein the first core unit is configured to translate, independently of the second core unit, through the duct side opening toward the room side opening, the room side opening is sized to retain the first core unit within the housing, and the second core unit is configured to translate through the duct side opening toward the room side opening to abut the first core unit.

4. The grille assembly of claim 3, wherein, in the installed configuration of the core, the first subset of blades and the second subset of blades form a plurality of deviated channels extending from an inlet defined by the first core unit to an outlet defined by the second core unit.

5. The grille assembly of claim 1, wherein the plurality of blades is a first plurality of blades, and wherein the core comprises a second plurality of blades arranged in a cross-wise configuration with the first plurality of blades to form a grid pattern.

6. The grille assembly of claim 5, wherein the second plurality of blades arranged in the cross-wise configuration with the first plurality of blades forms a plurality of deviated channels extending through the core.

7. The grille assembly of claim 1, wherein the core is configured to translate through the duct side opening in a first direction toward the room side opening to transition to the installed configuration, wherein the grille assembly comprises a fastener configured to extend from the corridor, and wherein the fastener is configured to block translation of the core in a second direction, opposite the first direction, from the room side opening toward the duct side opening to retain the core in the installed configuration.

8. The grille assembly of claim 1, wherein the room side end comprises a flange extending outwardly from the corridor, and wherein the flange is configured to engage with a surface of a room to couple the grille assembly to the surface of the room.

9. A grille assembly, comprising:

a housing comprising a room facing end having a first opening, a duct facing end having a second opening, and a corridor extending between the first opening and the second opening; and a core configured to translate through the second opening, into the corridor, and toward the first opening, wherein the core comprises:

a first plurality of blades slanted in a first direction at a first non- perpendicular angle relative to a corridor axis, wherein the first plurality of blades forms a first plurality of channels that partially pass through the housing in an installed configuration of the core; and a second plurality of blades slanted in a second direction, substantially opposite the first direction, at a second non-perpendicular angle relative to the corridor axis, wherein the second plurality of blades forms a second plurality of channels that partially pass through the housing in the installed configuration of the core, wherein the second plurality of blades is configured to translate through the second opening into the corridor independently of the first plurality of blades, and wherein the first plurality of channels and the second plurality of channels are arranged to obstruct a line of sight through the corridor from the room facing end to the duct facing end of the housing.

10. The grille assembly of claim 9, wherein the core comprises a first core unit comprising the first plurality of blades and comprises a second core unit comprising the second plurality of blades, wherein the first core unit and the second core unit are separate structures.

11. The grille assembly of claim 10, wherein, in the installed configuration of the core, the first core unit abuts the second core unit, and the first plurality of channels and the second plurality of channels form a plurality of deviated channels extending from an inlet defined by the first core unit to an outlet defined by the second core unit.

12. The grille assembly of claim 9, wherein the core is configured to translate through the second opening, into the corridor, and toward the first opening along a first direction, wherein the grille assembly comprises a fastener configured to extend from the corridor, and wherein the fastener is configured to engage the core to block translation of the core in a second direction, opposite the first direction.

13. The grille assembly of claim 12, wherein the fastener comprises a deformable tab.

14. The grille assembly of claim 9, wherein the core comprises a third plurality of blades arranged in a cross-wise configuration with the first plurality of blades and the second plurality of blades to form a grid pattern of the core.

15. A grille assembly, comprising:

a housing comprising a first end having a first opening, a second end having a second opening, and a corridor extending between the first opening and the second opening;

a first core unit comprising a first plurality of blades spaced apart relative to one another and slanted in a first direction and at a first angle, wherein the first core unit is configured to be disposed within the corridor; and a second core unit separate from the first core unit and comprising a second plurality of blades spaced apart relative to one another and slanted in a second direction, substantially opposite the first direction, and at a second angle, wherein the first core unit is configured to translate through the second opening into the corridor independently of the second core unit, the second core unit is configured to translate through the second opening into the corridor independently of the first core unit, the first core unit and the second core unit are configured to abut one another within the corridor, and the first plurality of blades and second plurality of blades form a plurality of channels extending from an inlet defined by the first core unit to an outlet defined by the second core unit, and wherein each channel of the plurality of channels is deviated to obstruct a line of sight through the corridor from the first end to the second end of the housing.

16. The grille assembly of claim 15, comprising a third core unit separate from the first core unit and the second core unit, the third core unit comprising a third plurality of blades spaced apart relative to one another and extending in a third direction, different than the first direction and the second direction.

17. The grille assembly of claim 16, wherein the first angle and the second angle are non-perpendicular to a corridor axis, and wherein the third plurality of blades extends orthogonally to the corridor axis.

18. The grille assembly of claim 15, wherein the first end comprises a flange extending outwardly from the corridor, and the flange is configured to abut a wall, ceiling, or floor of a room.

19. The grille assembly of claim 15, wherein the first end is a room side end of the housing, the second end is a duct side end of the housing, the first opening is a room side opening formed in the room side end, and the second opening is a duct side opening formed in the duct side end.

* * * * *